US009428865B2

(12) United States Patent
Salam et al.

(10) Patent No.: US 9,428,865 B2
(45) Date of Patent: Aug. 30, 2016

(54) PAPER-STRENGTH AGENTS AND METHODS FOR IMPROVING PULP PRODUCTS

(71) Applicant: North Carolina State University, Raleigh, NC (US)

(72) Inventors: Abdus Salam, Raleigh, NC (US); Hasan Jameel, Raleigh, NC (US); Lucian Lucia, Raleigh, NC (US)

(73) Assignee: North Carolina State University, Raleigh, NC (US)

( * ) Notice: Subject to any disclaimer, the term of this patent is extended or adjusted under 35 U.S.C. 154(b) by 0 days.

(21) Appl. No.: 14/738,189

(22) Filed: Jun. 12, 2015

(65) Prior Publication Data

US 2015/0361618 A1 Dec. 17, 2015

Related U.S. Application Data

(60) Provisional application No. 62/011,072, filed on Jun. 12, 2014.

(51) Int. Cl.

| | |
|---|---|
| ***D21H 11/00*** | (2006.01) |
| ***D21H 21/18*** | (2006.01) |
| ***D21H 17/36*** | (2006.01) |
| ***D21H 17/28*** | (2006.01) |
| ***D21H 17/24*** | (2006.01) |
| ***D21H 11/14*** | (2006.01) |
| ***D21H 17/22*** | (2006.01) |

(52) U.S. Cl.

CPC ..... *D21H 21/18* (2013.01); *D21H 11/14* (2013.01); *D21H 17/22* (2013.01); *D21H 17/24* (2013.01); *D21H 17/28* (2013.01); *D21H 17/36* (2013.01)

(58) Field of Classification Search

CPC ..... D21H 21/18; D21H 21/00; D21H 17/28; D21H 17/24; D21H 17/36

USPC ..... 162/168.1

See application file for complete search history.

(56) References Cited

U.S. PATENT DOCUMENTS

| | | | | |
|---|---|---|---|---|
| 5,582,681 | A * | 12/1996 | Back | D21C 5/005 162/111 |
| 6,027,610 | A * | 2/2000 | Back | D21C 5/005 162/100 |
| 6,261,679 | B1 * | 7/2001 | Chen | A61F 13/53 264/45.2 |
| 6,602,994 | B1 | 8/2003 | Cash et al. | |

FOREIGN PATENT DOCUMENTS

| | | | |
|---|---|---|---|
| EP | 1036799 | A1 | 9/2000 |
| EP | 2428610 | A1 | 3/2012 |

(Continued)

OTHER PUBLICATIONS

Cao et al., New Nanocomposite Materials Reinforced with Flax Cellulose Nanocrystals in Waterborne Polyurethane, Biomacromolecules, 8:899-904, 2007.

Hasani, et al., Cationization of Cellulose by Using N-Oxiranylmethyl-NMethylmorpholinium Chloride and 2-Oxiranylpyridine as Etherification Agents, Journal of Applied Polymer Science, 114:1449-1456, 2009.

Hasani et al., Cationic surface functionalization of cellulose nanocrystals, Soft Matter, 4:2238-2244, 2008.

(Continued)

*Primary Examiner* — Mark Halpern

(74) *Attorney, Agent, or Firm* — Meunier Carlin & Curfman LLC

(57) ABSTRACT

Paper strength agents comprising a vegetable protein or polysaccharide and a cross linker are disclosed. Methods of preparing such agents and using them to increase the strength of a pulp product are also disclosed.

22 Claims, 4 Drawing Sheets

(56) References Cited

FOREIGN PATENT DOCUMENTS

| | | | |
|---|---|---|---|
| JP | 2012214943 | A | 11/2012 |
| WO | 2010125247 | A2 | 11/2010 |
| WO | 2010134868 | A1 | 11/2010 |

OTHER PUBLICATIONS

Hasani et al., Correction: Cationic surface functionalization of cellulose nanocrystals, Soft Matter, 11:7440, 2015.

* cited by examiner

PAPER-STRENGTH AGENTS AND METHODS FOR IMPROVING PULP PRODUCTS

CROSS REFERENCE TO RELATED APPLICATIONS

This application claims the benefit of priority to U.S. Provisional Application 62/011,072, filed Jun. 12, 2014, which is incorporated by reference herein in its entirety.

FIELD

The disclosed subject matter relates to processes and agents for paper product manufacturing.

BACKGROUND

In the manufacture of paper products such as paper, cardboard, and the like from pulp, the strength properties of the final product can be increased by adding so called "paper strength agents." Paper strength agents can also allow for a reduction in the overall basis weight of the paper product to achieve the same paper strength and thus save on the cost of cellulosic raw materials. Conventional paper strength agents include starches, urea/formaldehyde resins, melamine/formaldehyde resins, acrylamide copolymers, polyamidoamine/epichlorohydrin resins, carboxymethylcellulose, guar gum, and chitosan. Among these, the acrylamide copolymers and starches are the most often applied.

Paper strength agents are also used when preparing recycled paper products from waste paper. The paper strength agents help improve the durability of recycled product, which otherwise could be lacking given the properties of the waste paper raw materials. Cardboard is one such product that is often prepared from recycled paper. Approximately 70% of all corrugated cardboard is recycled and at least 50% of all new boxes come from recycled material. In China, nearly 100% of all boxes come from recycled material.

Cardboard can be recycled about six times before it becomes nearly useless. Thus the use of paper strength agents can help extend the life and usefulness of recycled cardboard products. Still, however, there is a need for new techniques and products for improving the durability of paper products, especially recycled products. The compositions and methods disclosed herein address these and other needs.

SUMMARY

In accordance with the purposes of the disclosed methods, as embodied and broadly described herein, the disclosed subject matter relates to compositions and methods of making and using the compositions. More specifically, disclosed herein are paper strength agents and methods for preparing such paper strength agents. Also disclosed are methods of using the disclosed paper strength agents in preparing paper products.

In specific aspects, the disclosed paper strength agents can be vegetable protein or polysaccharides and a multi-functional cross linker. Certain examples of vegetable proteins or polysaccharides that can be used herein include soy protein flour, corn starch, and cellulose nanocrystals, though others are specific mentioned herein. These molecules can be cross-linked in an esterification reaction with a multifunctional cross linker, as disclosed herein, or additionally or alternatively they can be further bonded, complexed, or blended with a larger polymer cross linker like chitosan or polyvinyl alcohol.

In other aspects, disclosed are methods for producing a paper strength agent. The method includes esterifying a vegetable protein or polysaccharide with a multifunctional cross linker. The resulting product can additionally or alternatively bonded, complexed, or blended a large polymer cross linker like chitosan or polyvinyl alcohol. The disclosed methods can also include extracting cellulose nanocrystals from pulp or related cellulosic products.

In still other aspects, disclosed herein are method of preparing a paper product that includes mixing one or more of the paper strength agents disclosed herein with pulp. Mixtures of pulp and one or more of the disclosed paper strength agents are also disclosed herein. The use of the disclosed paper strength agents can improve the strength, water repellency, and/or optical properties of a paper product as compared to a control without the paper strength agent.

Additional advantages will be set forth in part in the description that follows or may be learned by practice of the aspects described below. The advantages described below will be realized and attained by elements and combinations particularly pointed out in the appended claims. It is to be understood that both the foregoing general description and the following detailed description are exemplary and explanatory only and are not restrictive.

BRIEF DESCRIPTION OF THE FIGURES

The accompanying Figures, which are incorporated in and constitute a part of this specification, illustrate several aspects described below.

DETAILED DESCRIPTION

Figure 1:
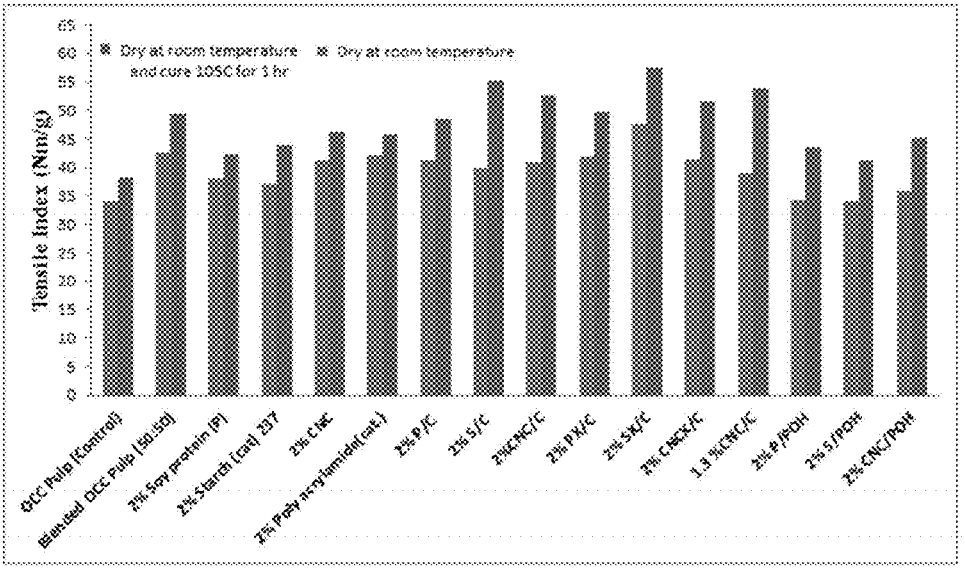
FIG. 1 is a graph depicting tensile strength of OCC pulp, blend OCC pulp, and paper strength agent treated OCC pulp hand sheet.

The details of the disclosed compounds, compositions, and methods can be understood more readily by reference to the following detailed description of specific aspects of the disclosed subject matter and the Examples and Figures included therein.

Before the present compounds, compositions, and methods are disclosed and described, it is to be understood that the aspects described below are not limited to specific synthetic methods or specific reagents, as such may, of course, vary. It is also to be understood that the terminology used herein is for the purpose of describing particular aspects only and is not intended to be limiting.

In this specification and in the claims that follow, reference will be made to a number of terms, which shall be defined to have the following meanings:

Throughout the description and claims of this specification the word "comprise" and other forms of the word, such as "comprising" and "comprises," means including but not limited to, and is not intended to exclude, for example, other additives, components, integers, or steps.

As used in the description and the appended claims, the singular forms "a," "an," and "the" include plural referents unless the context clearly dictates otherwise. Thus, for example, reference to "a composition" includes mixtures of two or more such compositions, reference to "the compound" includes mixtures of two or more such compounds, reference to "an agent" includes mixture of two or more such agents, and the like.

"Optional" or "optionally" means that the subsequently described event or circumstance can or cannot occur, and that the description includes instances where the event or circumstance occurs and instances where it does not.

Chemical Definitions

As used herein, the term "substituted" is contemplated to include all permissible substituents of organic compounds. In a broad aspect, the permissible substituents include acyclic and cyclic, branched and unbranched, carbocyclic and heterocyclic, and aromatic and nonaromatic substituents of organic compounds. Illustrative substituents include, for example, those described below. The permissible substituents can be one or more and the same or different for appropriate organic compounds. For purposes of this disclosure, the heteroatoms, such as nitrogen, can have hydrogen substituents and/or any permissible substituents of organic compounds described herein which satisfy the valences of the heteroatoms. This disclosure is not intended to be limited in any manner by the permissible substituents of organic compounds. Also, the terms "substitution" or "substituted with" include the implicit proviso that such substitution is in accordance with permitted valence of the substituted atom and the substituent, and that the substitution results in a stable compound, e.g., a compound that does not spontaneously undergo transformation such as by rearrangement, cyclization, elimination, etc.

"$Z^1$," "$Z^2$," "$Z^3$," and "$Z^4$" are used herein as generic symbols to represent various specific substituents. These symbols can be any substituent, not limited to those disclosed herein, and when they are defined to be certain substituents in one instance, they can, in another instance, be defined as some other substituents.

The term "alkyl" as used herein is a branched or unbranched saturated hydrocarbon group of 1 to 24 carbon atoms, for example 1 to 3, 1 to 4, 1 to 5, 1 to 6, 1 to 7, 1 to 8, 1 to 9, 1 to 10, or 1 to 15 carbon atoms, such as methyl, ethyl, n-propyl, isopropyl, n-butyl, isobutyl, t-butyl, pentyl, hexyl, heptyl, octyl, nonyl, decyl, dodecyl, tetradecyl, hexadecyl, eicosyl, tetracosyl, and the like. The alkyl group can also be substituted or unsubstituted. The alkyl group can be substituted with one or more groups including, but not limited to, alkyl, halogenated alkyl, alkoxyl, alkenyl, alkynyl, aryl, heteroaryl, aldehyde, amino, amido, carboxylic acid, ester, ether, halide, hydroxyl, ketone, nitro, silyl, sulfo-oxo, sulfonyl, sulfone, sulfoxide, thiol, or azide as described below.

Throughout the specification "alkyl" is generally used to refer to both unsubstituted alkyl groups and substituted alkyl groups; however, substituted alkyl groups are also specifically referred to herein by identifying the specific substituent(s) on the alkyl group. For example, the term "halogenated alkyl" specifically refers to an alkyl group that is substituted with one or more halide, e.g., fluorine, chlorine, bromine, or iodine. The term "alkoxyalkyl" specifically refers to an alkyl group that is substituted with one or more alkoxy groups, as described below. The term "alkylamino" specifically refers to an alkyl group that is substituted with one or more amino groups, as described below, and the like. When "alkyl" is used in one instance and a specific term such as "alkylalcohol" is used in another, it is not meant to imply that the term "alkyl" does not also refer to specific terms such as "alkylalcohol" and the like.

This practice is also used for other groups described herein. That is, while a term such as "cycloalkyl" refers to both unsubstituted and substituted cycloalkyl moieties, the substituted moieties can, in addition, be specifically identified herein; for example, a particular substituted cycloalkyl can be referred to as, e.g., an "alkylcycloalkyl." Similarly, a substituted alkoxy can be specifically referred to as, e.g., a "halogenated alkoxyl," a particular substituted alkenyl can be, e.g., an "alkenylalcohol," and the like. Again, the practice of using a general term, such as "cycloalkyl," and a specific term, such as "alkylcycloalkyl," is not meant to imply that the general term does not also include the specific term.

The term "alkoxyl" as used herein is an alkyl group bound through a single, terminal ether linkage; that is, an "alkoxyl" group can be defined as $—OZ^1$ where $Z^1$ is alkyl as defined above.

The term "alkenyl" as used herein is a hydrocarbon group of from 2 to 24 carbon atoms, for example, 2 to 5, 2 to 10, 2 to 15, or 2 to 20 carbon atoms, with a structural formula containing at least one carbon-carbon double bond. Asymmetric structures such as $(Z^1Z^2)C{=}C(Z^3Z^4)$ are intended to include both the E and Z isomers. This can be presumed in structural formulae herein wherein an asymmetric alkene is present, or it can be explicitly indicated by the bond symbol C═C. The alkenyl group can be substituted with one or more groups including, but not limited to, alkyl, halogenated alkyl, alkoxyl, alkenyl, alkynyl, aryl, heteroaryl, aldehyde, amino, amido, carboxylic acid, ester, ether, halide, hydroxyl, ketone, nitro, silyl, sulfo-oxo, sulfonyl, sulfone, sulfoxide, thiol, or azide, as described below.

The term "alkynyl" as used herein is a hydrocarbon group of 2 to 24 carbon atoms, for example 2 to 5, 2 to 10, 2 to 15, or 2 to 20 carbon atoms, with a structural formula containing at least one carbon-carbon triple bond. The alkynyl group can be substituted with one or more groups including, but not limited to, alkyl, halogenated alkyl, alkoxyl, alkenyl, alkynyl, aryl, heteroaryl, aldehyde, amino, amido, carboxylic acid, ester, ether, halide, hydroxyl, ketone, nitro, silyl, sulfo-oxo, sulfonyl, sulfone, sulfoxide, thiol, or azide, as described below.

The term "aryl" as used herein is a group that contains any carbon-based aromatic group including, but not limited to, benzene, naphthalene, phenyl, biphenyl, phenoxybenzene, and the like. The term "heteroaryl" is defined as a group that contains an aromatic group that has at least one heteroatom incorporated within the ring of the aromatic group. Examples of heteroatoms include, but are not limited to, nitrogen, oxygen, sulfur, and phosphorus. The term "non-heteroaryl," which is included in the term "aryl," defines a group that contains an aromatic group that does not contain a heteroatom. The aryl or heteroaryl group can be substituted or unsubstituted. The aryl or heteroaryl group can be substituted with one or more groups including, but not limited to, alkyl, halogenated alkyl, alkoxyl, alkenyl, alkynyl, aryl, heteroaryl, aldehyde, amino, amido, carboxylic acid, ester, ether, halide, hydroxyl, ketone, nitro, silyl, sulfo-oxo, sulfonyl, sulfone, sulfoxide, thiol, or azide, as described herein. The term "biaryl" is a specific type of aryl group and is included in the definition of aryl. Biaryl refers to two aryl groups that are bound together via a fused ring structure, as in naphthalene, or are attached via one or more carbon-carbon bonds, as in biphenyl.

The term "cycloalkyl" as used herein is a non-aromatic carbon-based ring composed of at least three carbon atoms. Examples of cycloalkyl groups include, but are not limited to, cyclopropyl, cyclobutyl, cyclopentyl, cyclohexyl, etc. The term "heterocycloalkyl" is a cycloalkyl group as defined above where at least one of the carbon atoms of the ring is substituted with a heteroatom such as, but not limited to, nitrogen, oxygen, sulfur, or phosphorus. The cycloalkyl group and heterocycloalkyl group can be substituted or unsubstituted. The cycloalkyl group and heterocycloalkyl group can be substituted with one or more groups including, but not limited to, alkyl, alkoxyl, alkenyl, alkynyl, aryl, heteroaryl, aldehyde, amino, amido, carboxylic acid, ester, ether, halide, hydroxyl, ketone, nitro, silyl, sulfo-oxo, sulfonyl, sulfone, sulfoxide, thiol, or azide, as described herein.

The term "cycloalkenyl" as used herein is a non-aromatic carbon-based ring composed of at least three carbon atoms and containing at least one double bound, i.e., C═C. Examples of cycloalkenyl groups include, but are not limited to, cyclopropenyl, cyclobutenyl, cyclopentenyl, cyclopentadienyl, cyclohexenyl, cyclohexadienyl, and the like. The term "heterocycloalkenyl" is a type of cycloalkenyl group as defined above, and is included within the meaning of the term "cycloalkenyl," where at least one of the carbon atoms of the ring is substituted with a heteroatom such as, but not limited to, nitrogen, oxygen, sulfur, or phosphorus. The cycloalkenyl group and heterocycloalkenyl group can be substituted or unsubstituted. The cycloalkenyl group and heterocycloalkenyl group can be substituted with one or more groups including, but not limited to, alkyl, alkoxyl, alkenyl, alkynyl, aryl, heteroaryl, aldehyde, amino, amido, carboxylic acid, ester, ether, halide, hydroxyl, ketone, nitro, silyl, sulfo-oxo, sulfonyl, sulfone, sulfoxide, thiol, or azide, as described herein.

The term "cyclic group" is used herein to refer to either aryl groups, non-aryl groups (i.e., cycloalkyl, heterocycloalkyl, cycloalkenyl, and heterocycloalkenyl groups), or both. Cyclic groups have one or more ring systems that can be substituted or unsubstituted. A cyclic group can contain one or more aryl groups, one or more non-aryl groups, or one or more aryl groups and one or more non-aryl groups.

The term "carbonyl" as used herein is represented by the formula —C(O)$Z^1$ where $Z^1$ can be a hydrogen, hydroxyl, alkoxyl, alkyl, halogenated alkyl, alkenyl, alkynyl, aryl, heteroaryl, cycloalkyl, cycloalkenyl, heterocycloalkyl, or heterocycloalkenyl group described above. Throughout this specification "C(O)" or "CO" is a short hand notation for C═O.

The term "azide" as used herein is represented by the formula —N═N═N.

The term "aldehyde" as used herein is represented by the formula —C(O)H.

The terms "amine" or "amino" as used herein are represented by the formula —N$Z^1Z^2$, where $Z^1$ and $Z^2$ can each be substitution group as described herein, such as hydrogen, an alkyl, halogenated alkyl, alkenyl, alkynyl, aryl, heteroaryl, cycloalkyl, cycloalkenyl, heterocycloalkyl, or heterocycloalkenyl group described above. "Amido" is —C(O)N$Z^1Z^2$.

The term "carboxylic acid" as used herein is represented by the formula —C(O)OH. A "carboxylate" or "carboxyl" group as used herein is represented by the formula —C(O)$O^-$.

The term "ester" as used herein is represented by the formula —OC(O)$Z^1$ or —C(O)O$Z^1$, where $Z^1$ can be an alkyl, halogenated alkyl, alkenyl, alkynyl, aryl, heteroaryl, cycloalkyl, cycloalkenyl, heterocycloalkyl, or heterocycloalkenyl group described above.

The term "ether" as used herein is represented by the formula $Z^1OZ^2$, where $Z^1$ and $Z^2$ can be, independently, an alkyl, halogenated alkyl, alkenyl, alkynyl, aryl, heteroaryl, cycloalkyl, cycloalkenyl, heterocycloalkyl, or heterocycloalkenyl group described above.

The term "ketone" as used herein is represented by the formula $Z^1$C(O)$Z^2$, where $Z^1$ and $Z^2$ can be, independently, an alkyl, halogenated alkyl, alkenyl, alkynyl, aryl, heteroaryl, cycloalkyl, cycloalkenyl, heterocycloalkyl, or heterocycloalkenyl group described above.

The term "halide" or "halogen" as used herein refers to the fluorine, chlorine, bromine, and iodine.

The term "hydroxyl" as used herein is represented by the formula —OH.

The term "nitro" as used herein is represented by the formula —$NO_2$.

The term "silyl" as used herein is represented by the formula —Si$Z^1Z^2Z^3$, where $Z^1$, $Z^2$, and $Z^3$ can be, independently, hydrogen, alkyl, halogenated alkyl, alkoxyl, alkenyl, alkynyl, aryl, heteroaryl, cycloalkyl, cycloalkenyl, heterocycloalkyl, or heterocycloalkenyl group described above.

The term "sulfonyl" is used herein to refer to the sulfo-oxo group represented by the formula —$S(O)_2Z^1$, where $Z^1$ can be hydrogen, an alkyl, halogenated alkyl, alkenyl, alkynyl, aryl, heteroaryl, cycloalkyl, cycloalkenyl, heterocycloalkyl, or heterocycloalkenyl group described above.

The term "sulfonylamino" or "sulfonamide" as used herein is represented by the formula —$S(O)_2NH$—.

The term "thiol" as used herein is represented by the formula —SH.

The term "thio" as used herein is represented by the formula —S—.

"$R^1$," "$R^2$," "$R^3$," "$R^n$," etc., where n is some integer, as used herein can, independently, possess one or more of the groups listed above. For example, if $R^1$ is a straight chain alkyl group, one of the hydrogen atoms of the alkyl group can optionally be substituted with a hydroxyl group, an alkoxy group, an amine group, an alkyl group, a halide, and the like. Depending upon the groups that are selected, a first group can be incorporated within second group or, alternatively, the first group can be pendant (i.e., attached) to the second group. For example, with the phrase "an alkyl group comprising an amino group," the amino group can be incorporated within the backbone of the alkyl group. Alternatively, the amino group can be attached to the backbone of the alkyl group. The nature of the group(s) that is (are) selected will determine if the first group is embedded or attached to the second group.

Unless stated to the contrary, a formula with chemical bonds shown only as solid lines and not as wedges or dashed lines contemplates each possible isomer, e.g., each enantiomer, diastereomer, and meso compound, and a mixture of isomers, such as a racemic or scalemic mixture.

Reference will now be made in detail to specific aspects of the disclosed materials, compounds, compositions, articles, and methods, examples of which are illustrated in the accompanying Examples and Figures.

Paper Strength Agents

Disclosed herein are paper strength agents based on vegetable proteins or polysaccharides and their use in improving certain strength characteristics of pulp products (e.g., virgin and recycled paper and cardboard). For example, the disclosed paper strength agents can be used to increase the strength of old corrugated container (OCC) as well as virgin pulp products (see e.g., Table 1). The disclosed paper strength agents comprise a vegetable protein or polysaccharide that has be cross-linked with a multivalent cross linker.

Vegetable Proteins

In the disclosed paper strength agents, the base molecule can be a vegetable protein. Specific examples of vegetable proteins that are suitable for use herein include soy proteins, rice proteins, wheat proteins, barley proteins, rye proteins, pea proteins, bean proteins, cottonseed proteins, legume proteins, flax seed proteins, corn proteins, gelatin, and the like, including any combinations thereof. Nut proteins and mycoproteins can also be used.

In specific examples, the vegetable protein can be a soy protein. Suitable soy proteins can be either soy protein flour, soy protein concentrate, or soy protein isolate. In a preferred example, the paper strength agent comprises a soy protein flour that has been cross-linked and optionally functionalized or complexed as disclosed herein.

In other examples, the vegetable protein can be a rice protein concentrate, rice protein isolate, corn protein concentrate, corn gluten meal, wheat gluten, sorghum protein concentrate, oat protein concentrate, barley protein concentrate, barley protein isolate, rye protein concentrate, rye protein isolate, pea protein concentrate, pea protein isolate, and the like. Any of these vegetable proteins can be cross linked as disclosed herein, as well as optionally functionalized or complexed.

Polysaccharides

In the disclosed paper strength agents, the base molecule can be a polysaccharide. Specific examples of polysaccharides that are suitable for use herein include starches, modified celluloses, gums, and related biomacromolecules with various modifications (specifically to surface charges: both low and high valencies for cationic and anionic, in addition to amphoteric compounds).

In specific examples, the polysaccharide can be a starch. Examples of suitable starches include corn starch, sweet potato starch, potato starch, tapioca starch, wheat starch, and related vegetable starches. In a preferred example, the polysaccharide is a corn starch. The starches can also be esterified starches, ferment-modified starches, hydrolyzed starches, cationic starches, or amphoteric starch. Any of these polysaccharides can be cross linked as disclosed herein, as well as optionally functionalized or complexed.

In other examples, the polysaccharide can be a modified cellulose. Examples of suitable celluloses include methylcellulose (MC), hydropropylmethylcellulose (HPMC), hydroxyethylmethylcellulose (HEMC), hydroxybutylmethylcellulose (HBMC), hydroxyethylethylcellulose (HEEC), and the mixture thereof. In one preferred example, the modified cellulose is a cellulosic nanocrystal.

In other examples, the polysaccharide can also be a gum. Examples of suitable gums include gums that are suitable for use herein include acacia, agar and associated algal polysaccharides, algin, alginic acid, alginates like ammonium, potassium, calcium, or propylene glycol alginate, pectins, amylopectin, carrageenan as well as calcium, sodium, or potassium carrageenan, carnitine, dextrin, gellan gum, guar gum, hydroxypropyl guar, hyaluronic acid, karaya gum, kelp, locust bean gum, naito gum, seierotium gum, tragacanth gum, xanthan gum, and mixtures thereof. Any of these polysaccharides can be cross linked as disclosed herein, as well as optionally functionalized or complexed.

Still further examples of polysaccharides that can be used herein include chitosan and chitin, glycogen, arabinoxylans, chondroitin (and chondroitin sulfate), N-acetylgalactosamine, and heteropolysaccharides (e.g., xylans). Any of these polysaccharides can be cross linked as disclosed herein, as well as optionally functionalized or complexed.

Cross Linkers

As noted, the disclosed paper strength agents comprise a vegetable protein or polysaccharide that has be cross-linked with a multivalent cross linker. The term "cross linker," as used herein, refers to one or more polyfunctional, e.g., bi-functional, tri-functional, tetra-functional, penta-functional molecules, and the like, which can be used to covalently cross-link the vegetable protein or polysaccharide. The cross linker can be attached to any part of the vegetable protein or polysaccharide, but will most likely form an ester with a carboxyl or hydroxyl group, or an amide with an amino group, of the vegetable protein or polysaccharide. It is preferable that the cross linker contain multiple carboxyl and/or amino moieties that can form multiple covalent, hydrogen, and/or ionic bonds with the vegetable proteins or polysaccharides, as well as the pulp fibers when used in the disclosed methods.

When bonded to the vegetable protein or polysaccharide, the cross linker can be represented by the moiety —C(O)$R^1$C(O)—, —C(O)O$R^1$OC(O)—, —OC(O)$R^1$C(O)—, —C(O)$R^1$N—, —C(O)O$R^1$NH—, —NH$R^1$NH—, or —C(O)NH$R^1$NHC(O)—; wherein $R^1$ is O, S, $C_1$—$C_{20}$ alkyl; $C_1$-$C_{20}$ heteroalkyl; $C_1$-$C_{20}$alkoxyl; $C_1$-$C_{20}$alkanoyloxyl; or $C_1$-$C_{20}$alkylamido, any of which can be optionally substituted with one or more substituents including halogen, alkoxyl, alkyl, alkenyl, cycloalkyl, cycloalkenyl, heterocycloalkyl, aryl, heteroaryl, amine, cyano, nitro, hydroxyl, carbonyl, acyl, carboxylic acid (—COOH), —C(O)$R^2$, —C(O)O$R^2$, carboxylate (—COO—), primary amide (e.g., —$CONH_2$), secondary amide (e.g., —CONH$R^2$), —C(O)N$R^2R^3$, —N$R^2R^3$, —N$R^2$S(O)$_2R^3$, —N$R^2$C(O)$R^3$, —S(O)$_2R^2$, —S$R^2$, and —S(O)$_2$N$R^2R^3$, sulfinyl group (e.g., —SO$R^2$), and sulfonyl group (e.g., —SOO$R^2$); wherein $R^2$ and $R^3$ can each independently be chosen from hydrogen, halogen, hydroxyl, alkyl, haloalkyl, alkenyl, alkynyl, cycloalkyl, heterocycloalkyl, aryl, heteroaryl, carbonyl, cyano, amino, alkylamino, dialkylamino, alkoxyl, aryloxyl, cycloalkyl, alkoxycarbonyl, aminocarbonyl, alkylaminocarbonyl, and dialkylaminocarbonyl.

In some examples, the cross linker can be an amino polycarboxylic acid. In some examples, the amino polycarboxylic acid can have from 3 to 30 carbon atoms. Examples of suitable amino polycarboxylic acids include, but are not limited to, 1,6-dicarboxylic-2-amino hexanoic acid, 1,7-dicarboxylic-2-amino heptanoic acid, 1,8-dicarboxylic-2-amino octanoic acid, α-aminosuccinic acid, β-aminoglutaric acid, β-aminosebacic acid, 2,6-piperidine dicarboxylic acid, 2,5-pyrrole dicarboxylic acid, 2-carboxypyrrole-5-acetic acid, 2-carboxypiperidine-6-propionic acid, 2-aminoadipic acid, 3-aminoadipic acid, α-aminoazelaic acid, 4-aminobenzene-1,3-dicarboxylic acid, nitrilotriacetic acid, N-hydroxyethyliminodiacetic acid, ethylenediaminediacetic acid, ethylenediaminetetraacetic acid, ethylenediaminetetraacetic acid, N-hydroxyethylethylenediaminetetraacetic acid, diethylenetriaminepentacetic acid, 1,2 cyclohexanediaminetetraacetic acid, trimethylenediaminetetraacetic acid, ethyleneglycol diethyl ether diamine tetraacetic acid (GEDTA), ethylenediaminetetrapropionic acid, or salts thereof. In preferred example, the cross linker is ethylenediaminetetraaetic acid, diethylenetriaminepentaacetic acid or a salt thereof.

In some examples, the cross linker can be a dicarboxylic acid. In some embodiments, the dicarboxylic acid can have from 3 to 30 carbon atoms. Examples of dicarboxylic acid include, but are not limited to, butanedioic acid, pentanedioic acid, hexanedioic acid, heptanedioic acid, octanedioic acid, nonanedioic acid, decanedioic acid, undecanedioic acid, dodecanedioic acid, tridecanedioic acid, 1,12-dodecanedicarboxylic acid, 1,15-pentadecanedicarboxylic acid, hexadecanedioic acid, and 1,15-pentadecanedicarboxylic acid. In some embodiments, the dicarboxylic acid is a halogenated dicarboxylic acid, hydroxy dicarboxylic acid, or ether dicarboxylic acid.

In some examples, the cross linker can be a polyol or a derivative thereof. The polyol can be a diol, triol, amino dialcohol, amino trialcohol, ethylene glycol, propylene glycol, glycerol, or a derivative thereof. In some examples, the polyol can have from 3 to 100 carbon atoms.

In some further examples, the cross linker can be blended with the vegetable protein or polysaccharide and either form a bond, a complex, or blend. Suitable cross linkers for these examples are large polymers and can be used with the vegetable protein or polysaccharide alone or when the vegetable protein or polysaccharide is cross linked with another cross linker disclosed herein. Examples of suitable polymers that can be used for these examples include, but are not limited to, poly(vinyl acetate); copolymers of styrene and alkyl acrylates; copolymers of vinyl acetate and acrylic acid; polyvinylpyrrolidone; dextran; carboxymethylcellulose; polyethylene glycol; polypropylene glycol; polyglycerol; polyalkylene; polyanhydrides; poly(ester anhydrides); polyhydroxy acids such as polylactide (PLA), polyglycolide (PGA), poly(lactide-co-glycolide) (PLGA), poly-3-hydroxybutyrate (PHB), and poly-4-hydroxybutyrate (P4HB); polycaprolactone; polyacrylates and polymethacrylates; polyanhydrides; polyorthoesters; polysytyrene (PS); poly (ethylene-co-maleic anhydride); alginate; polyacrylamides, and copolymers thereof, and combinations thereof. In a preferred example, the polymer is a polyvinyl alcohol. In another preferred example, the polymer is chitosan.

SPECIFIC EXAMPLES

Specific examples of paper strength agents include soy proteins, e.g., soy protein flour, cross-linked with chitosan, soy protein flour blended with chitosan, corn starch (e.g., cationic or amphoteric corn starch) cross-linked with chitosan, corn starch (e.g., cationic or amphoteric corn starch) blended with chitosan, cellulose nanocrystals cross-linked with chitosan, cellulose nanocrystals blended with chitosan, guar gum cross-linked with chitosan, guar gum blended with chitosan, carboxymethylcellulose cross-linked with chitosan, carboxymethylcellulose blended with chitosan, soy protein flour cross-linked with DTPA or EDTA and bonded to chitosan, soy protein flour cross-linked with DTPA or EDTA and blended with chitosan, corn starch (e.g., cationic or amphoteric corn starch) cross-linked with DTPA or EDTA and bonded to chitosan, corn starch (e.g., cationic or amphoteric corn starch) cross-linked with DTPA or EDTA and blended with chitosan, cellulose nanocrystals cross-linked with DTPA or EDTA and bonded to chitosan, cellulose nanocrystals cross-linked with DTPA or EDTA and blended with chitosan, guar gum cross-linked with DTPA or EDTA and bonded to chitosan, guar gum cross-linked with DTPA or EDTA and blended with chitosan, carboxymethylcellulose cross-linked with DTPA or EDTA and bonded to chitosan, carboxymethylcellulose cross-linked with DTPA or EDTA and blended with chitosan.

Further examples of paper strength agents include soy protein, e.g., soy protein flour, cross-linked with polyvinyl alcohol, soy protein flour blended with polyvinyl alcohol, corn starch (e.g., cationic or amphoteric corn starch) cross-linked with polyvinyl alcohol, corn starch (e.g., cationic or amphoteric corn starch) blended with polyvinyl alcohol, cellulose nanocrystals cross-linked with polyvinyl alcohol, cellulose nanocrystals blended with polyvinyl alcohol, guar gum cross-linked with polyvinyl alcohol, guar gum blended with polyvinyl alcohol, carboxymethylcellulose cross-linked with polyvinyl alcohol, carboxymethylcellulose blended with polyvinyl alcohol, soy protein flour cross-linked with DTPA or EDTA and bonded to polyvinyl alcohol, soy protein flour cross-linked with DTPA or EDTA and blended with polyvinyl alcohol, corn starch (e.g., cationic or amphoteric corn starch) cross-linked with DTPA or EDTA and bonded to polyvinyl alcohol, corn starch (e.g., cationic or amphoteric corn starch) cross-linked with DTPA or EDTA and blended with polyvinyl alcohol, cellulose nanocrystals cross-linked with DTPA or EDTA and bonded to polyvinyl alcohol, cellulose nanocrystals cross-linked with DTPA or EDTA and blended with polyvinyl alcohol, guar gum cross-linked with DTPA or EDTA and bonded to polyvinyl alcohol, guar gum cross-linked with DTPA or EDTA and blended with polyvinyl alcohol, carboxymethylcellulose cross-linked with DTPA or EDTA and bonded to polyvinyl alcohol, carboxymethylcellulose cross-linked with DTPA or EDTA and blended with polyvinyl alcohol.

Methods of Making

The paper strength agents disclosed herein can be prepared in a variety of ways known to one skilled in the art of organic synthesis or variations thereon as appreciated by those skilled in the art. The paper strength agents disclosed herein can be prepared from readily available starting materials. Optimum reaction conditions can vary with the particular reactants or solvents used, but such conditions can be determined by one skilled in the art.

Variations on the paper strength agents disclosed herein include the addition, subtraction, or movement of the various constituents as described for each compound. Similarly, when one or more chiral centers are present in a molecule, the chirality of the molecule can be changed. Additionally, compound synthesis can involve the protection and deprotection of various chemical groups. The use of protection and deprotection, and the selection of appropriate protecting groups can be determined by one skilled in the art. The chemistry of protecting groups can be found, for example, in Wuts and Greene, Protective Groups in Organic Synthesis, 4th Ed., Wiley & Sons, 2006, which is incorporated herein by reference in its entirety.

Reactions to produce the compounds described herein can be carried out in solvents, which can be selected by one of skill in the art of organic synthesis. Solvents can be substantially nonreactive with the starting materials (reactants), the intermediates, or products under the conditions at which the reactions are carried out, i.e., temperature and pressure. Reactions can be carried out in one solvent or a mixture of more than one solvent. Product or intermediate formation can be monitored according to any suitable method known in the art. For example, product formation can be monitored by spectroscopic means, such as nuclear magnetic resonance spectroscopy (e.g., $^{1}H$ or $^{13}C$) infrared spectroscopy, spectrophotometry (e.g., UV-visible), or mass spectrometry, or by chromatography such as high performance liquid chromatography (HPLC) or thin layer chromatography.

Disclosed are methods for making a paper strength agent. The disclosed paper strength agents can be prepared from vegetable proteins or polysaccharides and cross linker by contacting the vegetable protein or polysaccharide with the cross linker under conditions suitable for forming a bond between the vegetable protein or polysaccharide and the cross linker. These conditions can typically include solvents, mixing, and heating to from 20° C. to 200° C. For example, soy protein flour, corn starch, or cellulose nanocrystals, as do the other vegetable proteins and polysaccharides disclosed herein, all have hydroxyl or carboxyl groups that can be esterified with different types of cross linkers having carboxyl or hydroxyl groups. Alternatively, when the vegetable protein or polysaccharide has amino groups and the cross linker has carboxyl groups, or vice versa, amide bonds can form between the two reactants. Thus, by contacting the vegetable protein or polysaccharide with a carboxyl or hydroxyl containing cross linker at from 20° to 200° C. (e.g., from about 50° C. to about 150°, or about 80° C. to about 130° C.), for a period of from 5 minutes to 5 hours (e.g., from 1 hr to 3 hrs), a paper strength agent as disclosed herein can be prepared. The amount of cross linker agents can vary depending on the particular vegetable protein or polysaccharide, the amount of these materials, and the preferences of the practitioner.

This method of preparing a paper strength agent is exemplified in the following scheme with the cross linker diethylenetriaminepentaacetic acid (DTPA).

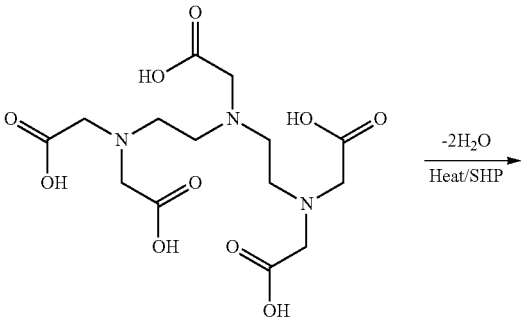

DTPA

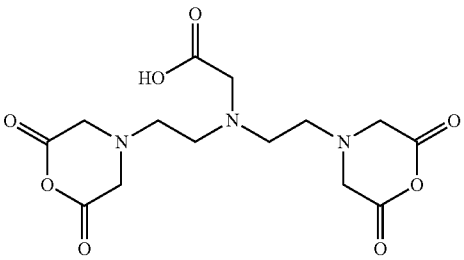

DTPA Dianhydride

-continued

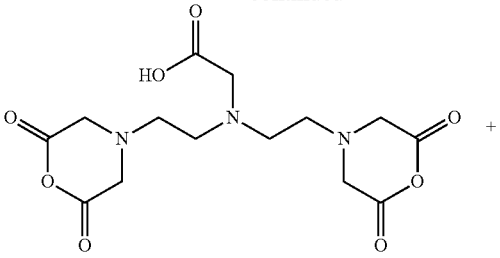

DTPA Dianhydride

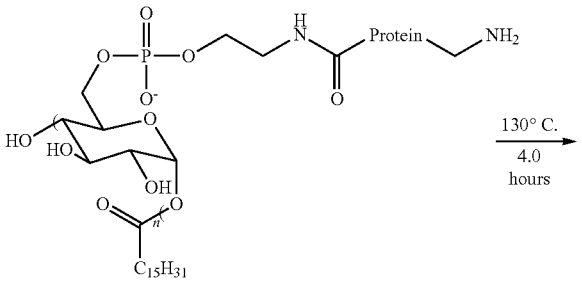

Soy Flour

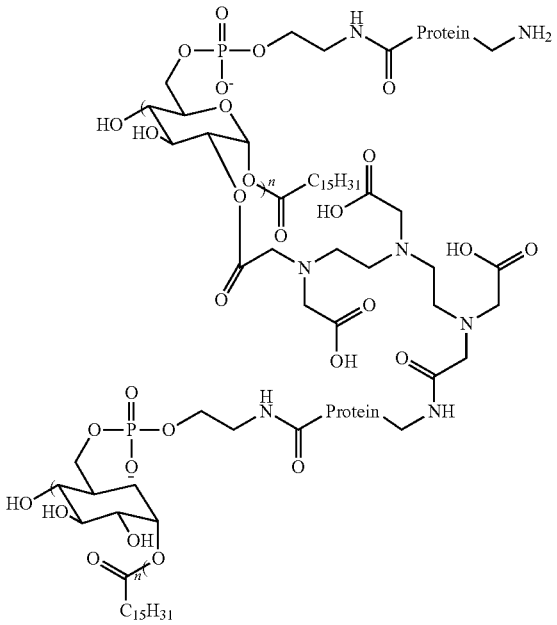

Soy Flour-DTPA

It is also contemplated that the cross linker can contain additional functional groups that, even after crosslinking the vegetable protein or polysaccharide, are available for coupling to additional compounds. In particular, chitosan or other polysaccharides, or polymers like polyvinylalcohol can be bonded to the available sites on the cross linker. For example, vegetable proteins or polysaccharides that have been cross-linked with a cross linker can be treated with additional compounds (e.g., chitosan or polyvinyl alcohol) to produced additional paper strength agents. This route is illustrated by the following scheme using chitosan.

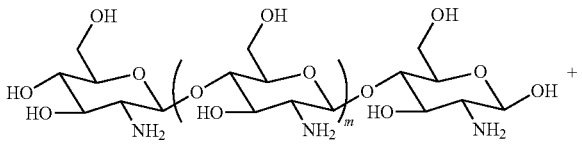

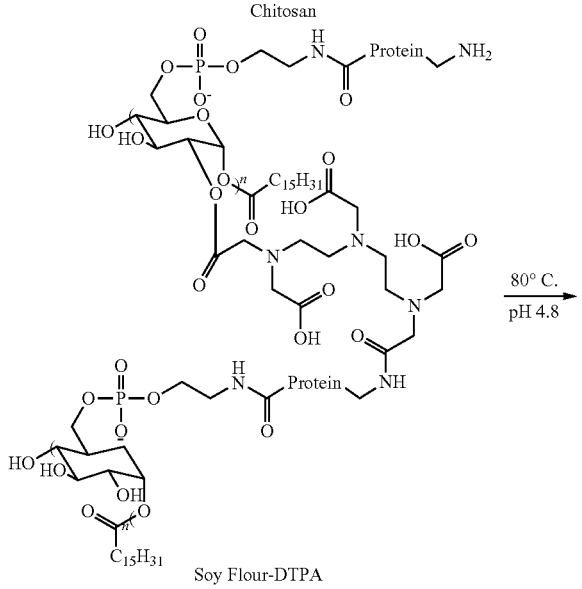

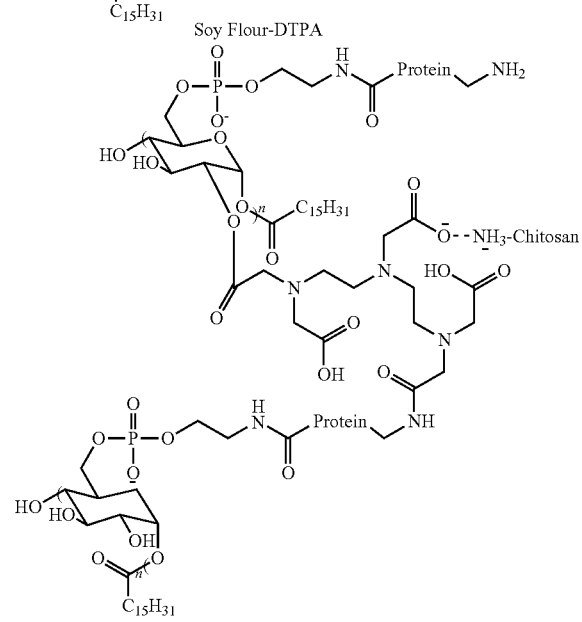

It is also possible to prepare paper strength agents by reacting a vegetable protein or polysaccharide, as disclosed herein, directly with a polymer, without prior treatment with a cross linker. For example, a vegetable protein or polysaccharide can be treated with poly(vinyl acetate); copolymers of styrene and alkyl acrylates; copolymers of vinyl acetate and acrylic acid; polyvinylpyrrolidone; dextran; carboxymethylcellulose; polyethylene glycol; polyalkylene; polyanhydrides; poly(ester anhydrides); polyhydroxy acids such as polylactide (PLA), polyglycolide (PGA), poly(lactide-co-glycolide) (PLGA), poly-3-hydroxybutyrate (PHB), and poly-4-hydroxybutyrate (P4HB); polycaprolactone; polyacrylates and polymethacrylates; polyanhydrides; polyorthoesters; polysytyrene (PS); poly(ethylene-co-maleic anhydride); alginate; polyacrylamides, and copolymers thereof, and combinations thereof. The product of this reaction can be a covalent bond between the polymer and the vegetable protein or polysaccharide, or it can be a complex or blend between the vegetable protein or polysaccharide and polymer.

Methods of Use

The disclosed paper strength agents can be mixed with pulp (e.g., OCC pulp) to significantly increase paper strength. Such mixing can be done either in a lab-scale setting in which addition is predicated upon proper mixing (e.g., Waring blender) or it can be done on the paper machine in the wet end as is done with starch or other paper strength agents. The disclosed paper strength agents can be blended with the pulp in amounts of from 0.1 to 10% by weight of the pulp. For example, the disclosed paper strength agents can be blended with the pulp in amounts of 0.1, 0.5, 1, 1.5, 2, 2.5, 3, 3.5, 4, 4.5, 6, 6.5, 7, 7., 8, 8.5, 9, 9.5 or 10 by weight of the pulp, where any of the stated values can form an upper or lower endpoint of a range. In preferred examples, the disclosed paper strength agents can be blended with the pulp in amounts of from 0.1 to 5%, from Ito 4%, from 1.5 to 3%, or 2% by weight of the pulp.

Also, more than one of the disclosed paper strength agents can be added to the pulp. Also, the disclosed paper strength agents can be used alone or in combination with any convention paper strength agent as a blend. In a preferred example, at least one paper strength agent blended or complex with chitosan is combined with the pulp.

In experiments, the disclosed paper strength agents showed excellent homogeneity and significantly improved viscosity when dissolved in water. After the various paper strength agents, made from their respective starting materials and various cross linkers, were mixed with pulp, these mixtures were formed into hand sheets and cured. Corrugated cardboard typically comes from recycled material and so the disclosed paper strength agents are particularly well suited for use in increasing the strength of recycled cardboard material, allowing otherwise unusable cardboard material to be used again.

The industry standards for testing cardboard strength are in measuring tensile, bursting, and tear strength. A commercial paper strength agent tested showed small increases in tensile and bursting strengths of 15 and 5%, respectively. The hand sheets incorporating the soy protein flour, starch, and/or cellulose nanocrystal-derived paper strength agents disclosed herein increased in tensile strength compared to an OCC pulp hand sheet control sample by 30, 50, and 40%, respectively. Bursting strength was increased 29, 46.5, and 45%, respectively, while tear strength decreased 25.7, 33.5, and 10.8%, respectively.

Additionally, the soy protein-derived product is resistant to bacteria, as opposed to unaltered soy proteins, which can develop an unpleasant odor when dissolved in water for 24 hours. The disclosed soy protein derivative did not develop an odor even after sixteen months.

In an example advantage, soy protein flour, cornstarch, and cellulose nanocrystal-derived paper strength agents can be produced that offer significant improvements in mechanical properties when incorporated into OCC pulp paper. Increases in tensile, bursting, STFI and inter-fiber bonding strengths as high as by 50, 46.5, 35.0 and 130.0%, respectively, have so far been observed.

There is an inverse trend between tensile and bursting strength increases and tear strength decreases. Paper strength agents that offer smaller increases in tensile and bursting strengths, while also offering smaller decreases in tear strength, can also be created if tear strength is the limiting factor in one's desired application.

Further, the presently disclosed subject matter allows previously unusable cardboard material to be used once again, representing an extension in the life cycle of a cardboard box and ultimately significant savings in material costs.

EXAMPLES

The following examples are set forth below to illustrate the methods and results according to the disclosed subject matter. These examples are not intended to be inclusive of all aspects of the subject matter disclosed herein, but rather to illustrate representative methods, compositions, and results. These examples are not intended to exclude equivalents and variations of the present invention, which are apparent to one skilled in the art.

Efforts have been made to ensure accuracy with respect to numbers (e.g., amounts, temperature, etc.) but some errors and deviations should be accounted for. Unless indicated otherwise, parts are parts by weight, temperature is in ° C. or is at ambient temperature, and pressure is at or near atmospheric. There are numerous variations and combinations of reaction conditions, e.g., component concentrations, temperatures, pressures, and other reaction ranges and conditions that can be used to optimize the product purity and yield obtained from the described process. Only reasonable and routine experimentation will be required to optimize such process conditions.

Example 1

Synthesis of Paper Strength Agents

Cellulose nanocrystals were extracted from bleached pulp with 3M HCl at 90° C. for 2 hrs. Cellulose nanocrystals (CNC), soy protein flour (P), and cornstarch (S) were separately esterified with diethylenetriaminepentaacetic acid (X) at 130° C. for 3 hours.

The cellulose nanocrystals, soy protein flour and starch derivatives were also cross-linked with chitosan (C) or polyvinyl alcohol (POH) separately at 80° C. for 1.5 hours. In addition, starch and cellulose nanocrystals is cross linked with chitosan as same the method described herein.

Example 2

Pulp Modification with Paper Strength Agents

In an experiment, about 2% of the paper strength additive (based on OD pulp) was mixed with OCC pulp slurry (0.3% consistency) and stirred for 30 minutes before making a hand sheet. The hand sheet was prepared with 600 mL pulp slurry (1.8 g OD pulp) in a hand sheet molder machine. The pulp slurry was also diluted with 10 L white or DI water into the hand sheet molder to produce uniform sheet. The hand sheet was dried at condition room temperature and then cured at 105° C. for 1 hour for further characterization.

Example 3

Analysis of Cardboard Properties

The cured and non cured hand sheets were characterized in terms of strength properties such as tensile, bursting, STFI (comparison), and inter-fiber bonding strength. The results are shown in FIGS. 1, 2, 3 and 4. EKA PL 2510 (cationic poly acrylamide) can be used as an existing commercial paper strength agent to compare with the paper strength agents disclosed herein. As a control, the OCC pulp (Freeness 400) can be used. Virgin soft wood kraft pulp (beating revolution 5000 PFI and freeness 530) was blended with OCC pulp (50:50) to increase strength properties.

Figure 2:
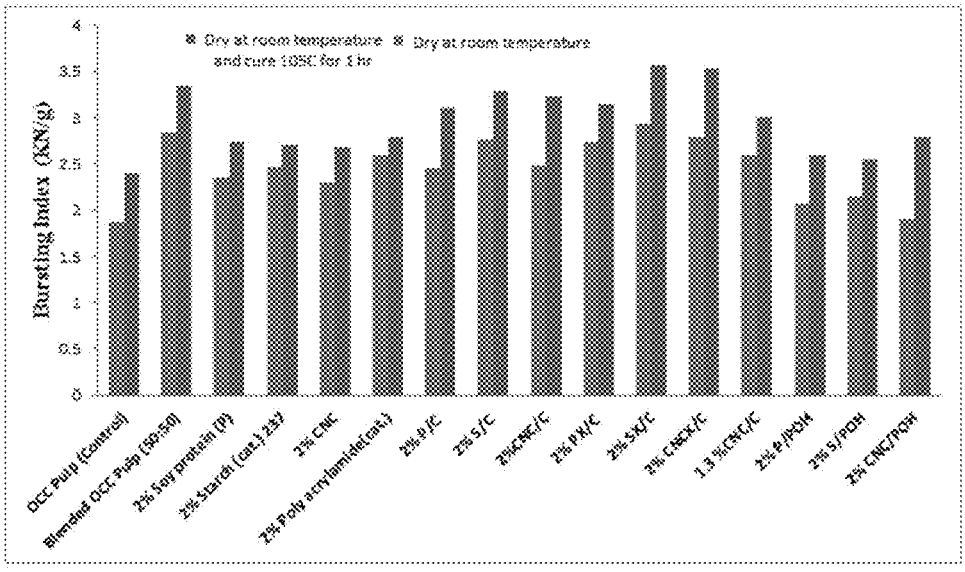
FIG. 2 is a graph depicting bursting strength of OCC pulp, blend OCC pulp, and paper strength agent treated OCC pulp hand sheet.
Figure 3:
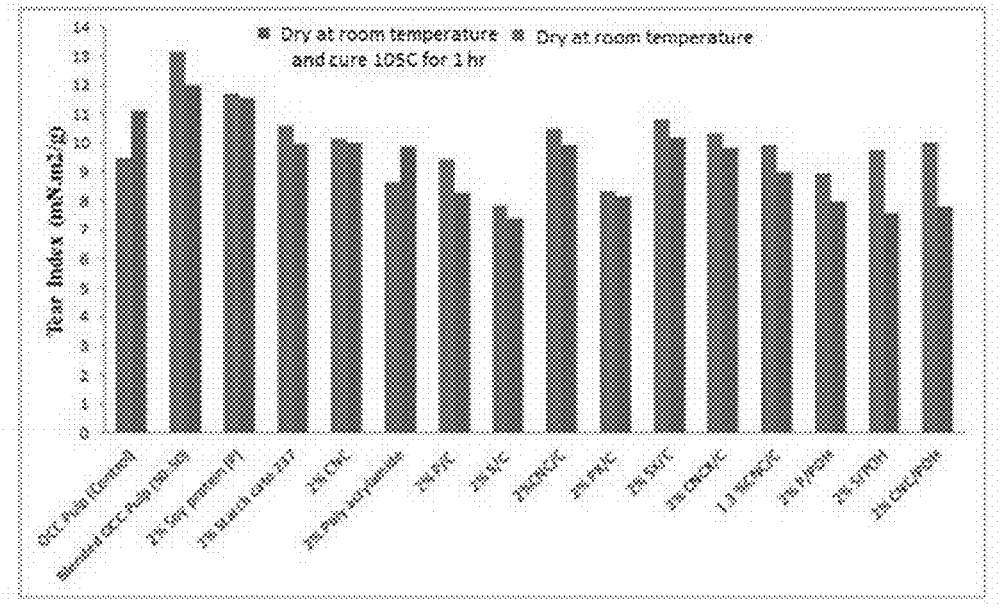
FIG. 3 is a graph depicting tear strength of OCC pulp, blend OCC pulp, and paper strength agent treated OCC pulp hand sheet.
Figure 4:
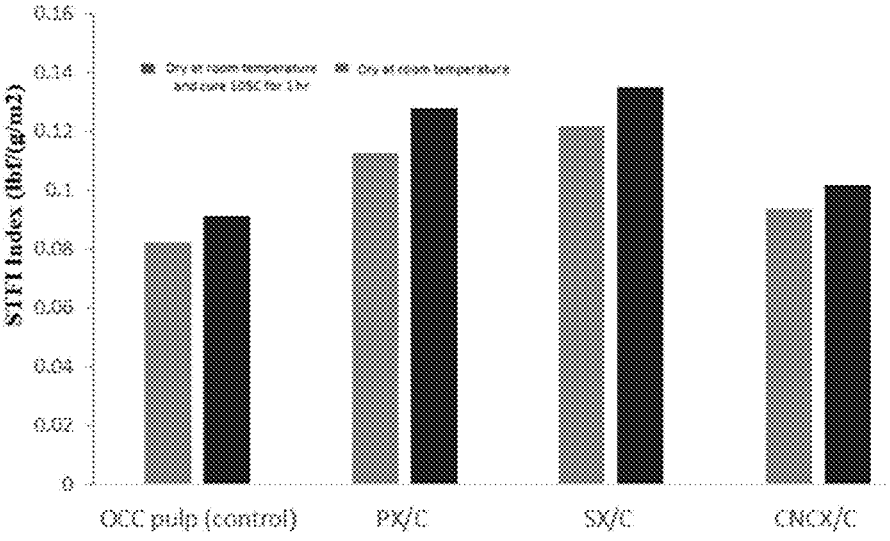
FIG. 4 is a graph depicting tear strength of OCC pulp, blend OCC pulp, and paper strength agent treated OCC pulp hand sheet.

The tensile and bursting strength of OCC pulp and blended OCC pulp hand sheets were 38 and 49 Nm/g, and 1.87 and 3.34 KN/g, respectively (FIGS. 1 and 2). But when OCC pulp was treated with 2% of soy protein flour, cationic starch, and cellulose nanocrystals separately, the tensile strength was increased 11, 14, and 12% respectively. But the interesting thing is that when OCC pulp was treated with 2% derivatives of soy protein flour such as P/C (soy protein bonded to chitosan), PX/C (soy protein cross-linked with DTPA and bonded to chitosan), and P/POH (soy protein cross-linked with polyvinyl alcohol) the tensile strengths were increased 27.4, 30.7, and 14.2% respectively. Similarly the tensile strength of corn starch derivatives such as S/C, SX/C, and S/POH were increased 44, 50, and 8%, and the cellulose nanocrystals derivatives such as CNC/C, CNCX/C, and CNC/POH was increased 38, 40, and 18.5% respectively (FIG. 1). However, the bursting strength of soy protein derivatives such as P/C, PX/C, and P/POH were increased 23, 28.7, and 8%, starch derivatives such as S/C, SX/C, and S/POH were increased 35, 46, and 6.5%, and the cellulose nanocrystals derivatives such as CNC/C, CNCX/C, and CNC/POH were increased 32.5, 45, and 16.2% respectively (FIG. 2). The tear strength was decreased in all of the carbohydrate derivatives treated samples compare to control except blended OCC pulp sample (FIG. 3). In addition, the STFI (comparison) strength was evaluated for PX/C, SX/C, and CNCX/C additive treated sample and increased 35, 37, and 28%, respectively (FIG. 4). In contrast, OCC pulp was also treated with 1.3% CNC/C instead of 2% to observe the effect of paper strength agent concentration. As a result, similar tensile strength properties were found when 2% paper strength agent was used (FIG. 1).

Only 1.3-2% of soy protein flour or corn starch or cellulose nanocrystals derivatives can give the following increases in strengths: 30-50% in tensile strength, 29-46% in bursting strength, 28-37% in STFI strength and significantly decreased tear strength compared to the control sample. In contrast, the tensile strength of carbohydrate derivatives treated sample was 38.2-59.3% higher than blended OCC pulp-1 and 1-16.4% higher than blended OCC pulp-2 (Table 1). Although the carbohydrates raw materials and carbohydrate derivatives (P/C, S/C and CNC/C) processing cost was very cheap compared to virgin pulp (5000PFI with 530 freeness) that was blended with OCC pulp to increase the OCC pulp strength.

In summary, the tensile strength of soy protein flour, starch and cellulose nanocrystals derivative treated sample (cured) increased 30, 50, and 40%, respectively. Similarly, bursting strength was increased 29, 46.5, and 45%, STFI was increased 35, 37, and 28%, inter-fiber bonding strength increased 130, 140, and 110%, and the tear strength decreased 25.7, 33.5, and 10.8%, respectively, compared to OCC pulp hand sheet control sample. To ensure the significance of different results between control and additive-treated pulp sheet, the t-test was evaluated based on tensile strength of pulp sheet. The P (provability) values are significantly lower than the $\alpha$ value 0.05 ($p<0.05$), so there was a basis to posit significant differences between the test performances results (tensile indices) between the control and soy protein flour derivatives additive-treated pulp sheet samples.

TABLE 1

Strength properties of different types of paper strength agent-treated OCC pulp hand sheets (Cured at 105° C. for 1 hour).

| Sample | Blended with Virgin Pulp | Use of paper strength agent | Added paper strength agent (%) (OD Pulp) | Tensile Index (Nm/g) | Bursting Index (KN/g) | Tear Index (mN · $M^2$/g) |
|---|---|---|---|---|---|---|
| OCC Pulp (control) | No | No | — | 38.15 | 2.4 | 11.13 |
| Blend OCC Pulp(50:50)-1 | Virgin pulp (Without beating) | No | — | 36.1 | 2.25 | 11.71 |
| Blend OCC Pulp(50:50)-2 | Virgin pulp (Beating with revelation 5000 PFI) | No | — | 49.4 | 3.30 | 12.10 |
| OCC Pulp | No | P/C | 2% | 48.6 | 3.1 | 8.3 |
| OCC Pulp | No | S/C | 2% | 55.3 | 3.3 | 7.4 |
| OCC Pulp | No | CNC/C | 2% | 52.8 | 3.2 | 9.9 |
| OCC Pulp | No | PX/C | 2% | 49.9 | 3.2 | 8.2 |
| OCC Pulp | No | SX/C | 2% | 57.5 | 3.6 | 10.2 |
| OCC Pulp | No | CNCX/C | 2% | 51.4 | 3.5 | 9.8 |
| OCC Pulp | No | CNC/C | 1.3% | 53.8 | 3.0 | 10.0 |
| OCC Pulp | No | Soy protein isolate(PI) | 2% | 38.4 | 2.5 | 9.6 |
| OCC Pulp | No | Commercial paper strength agent (Soy Flour) | 2% | 42.3 | 2.95 | 11.4 |
| OCC Pulp | No | Commercial paper strength agent (G-PAM) | 2% | 44.0 | 2.53 | 8.3 |
| OCC Pulp | No | Commercial paper strength agent (Cationic Starch) | 2% | 43.48 | 2.68 | 11.5 |
| OCC Pulp | No | Commercial paper strength agent (cationic polyacrylamide) | 2% | 45.8 | 2.8 | 8.5 |
| Virgin(kraft) | No | PX/C | 2% | 55.3 | 3.5 | 9.5 |
| Virgin(NSSC) | No | PX/C | 2% | 53.8 | 3.4 | 10.0 |
| OCC Pulp | No | Cationic cornstarch/C | 2% | 51.00 | 3.6 | 10.5 |
| OCC Pulp | No | Cationic corn starch-X/C | 2% | 53.11 | 3.7 | 9.8 |
| OCC Pulp | No | Amphoteric corn starch/C | 2% | 51.10 | 3.58 | 11.2 |
| OCC Pulp | No | Amphoteric corn starch-X/C | 2% | 56.07 | 3.72 | 10.17 |
| OCC Pulp | No | Guar gum/C | 2% | 45.5 | 3.1 | 11.0 |
| OCC Pulp | No | Guar gum-X/C | 2% | 48.9 | 3.36 | 9.0 |
| OCC Pulp | No | CMC/C | 2% | 46.45 | 3.23 | 11.8 |
| OCC Pulp | No | CMC-X/C | 2% | 49.8 | 3.40 | 9.5 |
| OCC Pulp | No | Commercial amphoteric corn starch | 2% | 44.10 | 2.88 | 12.8 |

Figure 5:
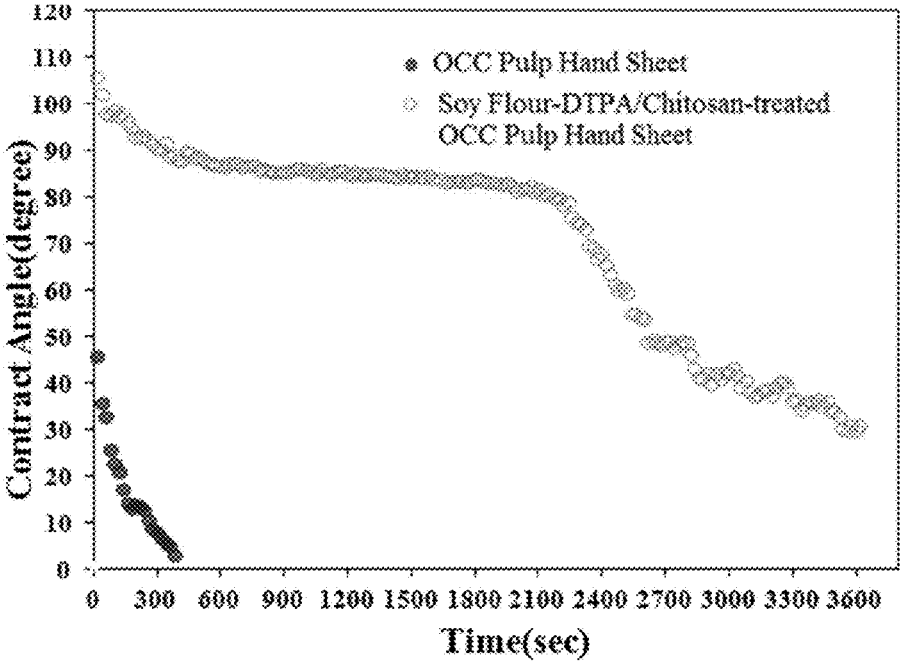
FIG. 5 is a graph depicting dynamic contact angle data for OCC pulp and paper strength agent treated OCC pulp hand sheet.
Figure 6:
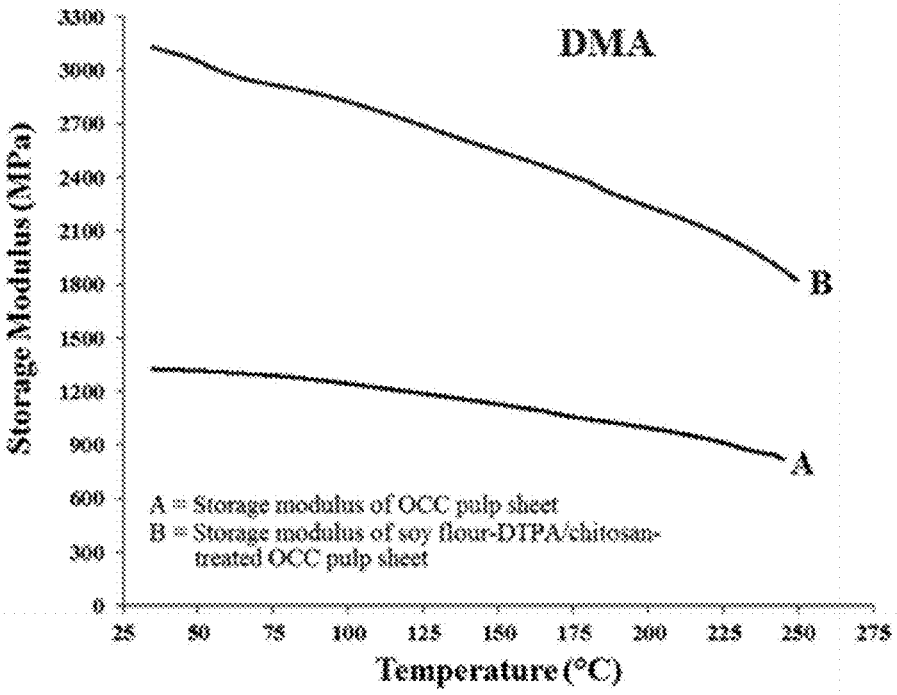
FIG. 6 is a graph depicting storage modulus data for OCC pulp and paper strength agent treated OCC pulp hand sheet.

Modified polysaccharide additive-treated OCC pulp sheet were also found to significantly increase gloss, dynamic contact angle, and storage modulus but decreased roughness compare to control sample. See Table 2 and FIGS. 5 and 6.

TABLE 2

| Additive | Gloss (GU ) | Roughness (UM) |
|---|---|---|
| No additive | 5.9 | 11.1 |
| Soy flour-DTPA/chitosan | 19.3 | 8.1 |
| Hyd. SPI-DTPA/chitosan | 11.8 | 8.9 |
| Corn Starch-DTPA/chitosan | 16.3 | 8.8 |
| Starch nanoparticle-DTP/chitosan | 17.4 | 7.5 |
| Cellulose Nanocrystals-DTPA/chitosan | 15.3 | 9.4 |

Example 5

Antimicrobial Properties of Paper Strength Agents

Figure 7:
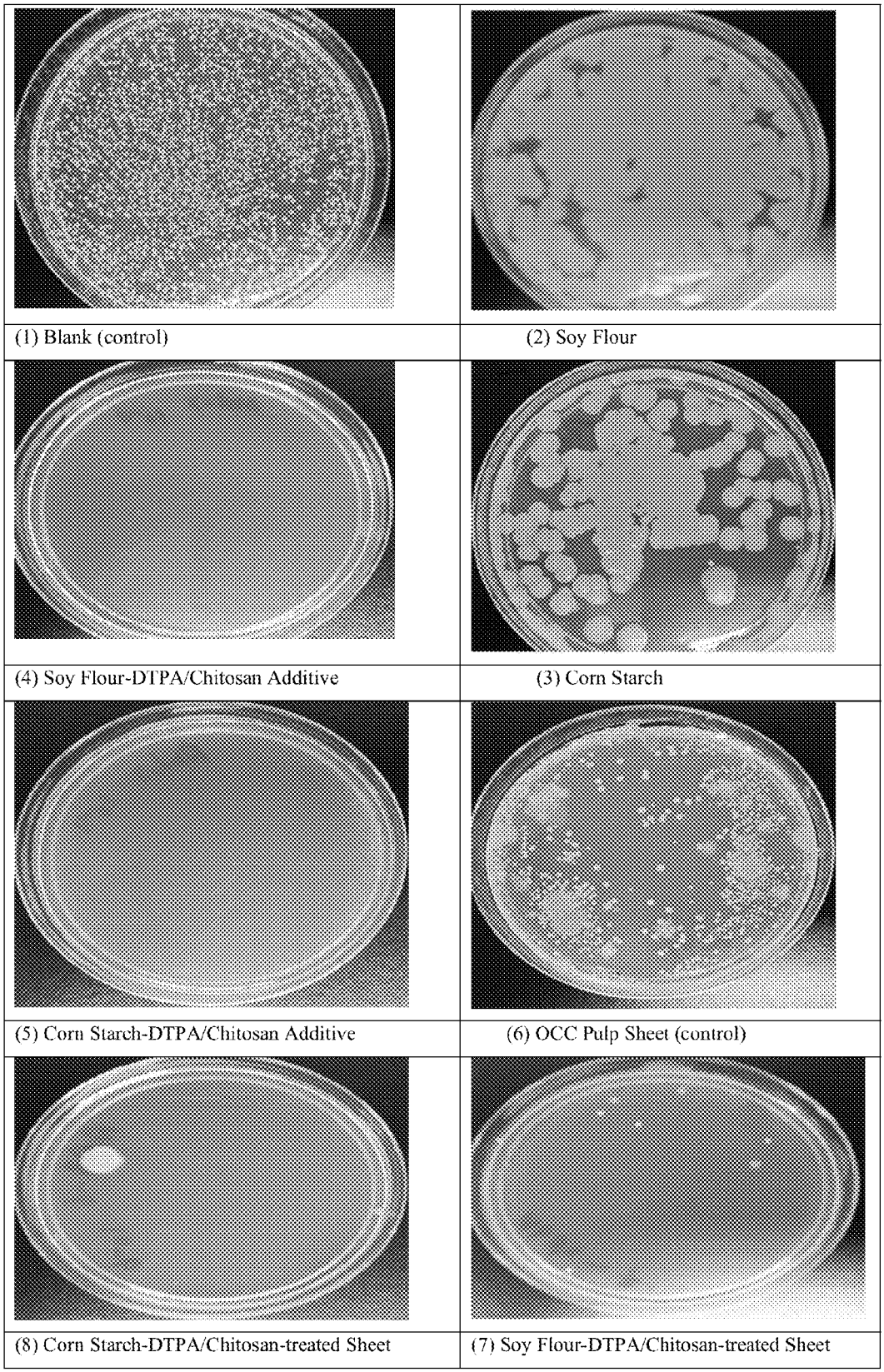
FIG. 7 is a group of photographs showing the antimicrobial activity of unmodified and modified paper strength agents.

Soy protein is a very cheap carbohydrate, but displays a problem: it can be digested by bacteria and emit a very bad odor when dissolved in water over 24 hours. So decomposition of modified and unmodified soy flour additives were studied under open-air conditions for nearly two years. It was found that the unmodified soy protein flour additive began decomposing within 24 hours as evidenced by the detection of foul odors. But, modified soy flour additive sample was not observed even after nearly two years. Antimicrobial activity of unmodified polysaccharide, modified polysaccharides and modified polysaccharide additive-treated recycle pulp hand sheet both were tested according to the standard antimicrobial test method AATCC 100. Soy protein flour and corn starch significantly increased bacteria growth compare to control sample. But modified soy protein flour and modified corn starch were shown to have strong antimicrobial activities and killed 100% bacteria. In addition, OCC pulp sheets did not show any antimicrobial activity but modified soy protein flour and modified corn starch-treated OCC pulp sheets killed about 93-97% bacteria compare to control sample (OCC). See FIG. 7.

Features from one embodiment or aspect may be combined with features from any other embodiment or aspect in any appropriate combination. For example, any individual or collective features of method aspects or embodiments may be applied to apparatus, system, product, or component aspects of embodiments and vice versa.

While the embodiments have been described in connection with the various embodiments of the various figures, it is to be understood that other similar embodiments may be used or modifications and additions may be made to the described embodiment for performing the same function without deviating therefrom. Therefore, the disclosed embodiments should not be limited to any single embodiment, but rather should be construed in breadth and scope in accordance with the appended claims.

What is claimed is:

1. A method for making a pulp product, comprising: adding a paper strength agent to a slurry of pulp, wherein the paper strength agent comprises a vegetable protein and a multifunctional cross linker.

2. The method of claim 1, wherein the vegetable protein comprises soy protein flour, soy protein concentrate, or soy protein isolate.

3. The method of claim 1, wherein the vegetable protein comprises a rice protein, wheat protein, barley protein, rye protein, pea protein, bean protein, cottonseed protein, legume protein, flax seed protein, corn protein, or combination thereof.

4. The method of claim 1, wherein the cross linker is an aminopolycarboxylic acid.

5. The method of claim 4, wherein the aminopolycarboxylic acid is ethylenediamine tetraacetic acid, diethylenetriaminepentaacetic acid, or a salt thereof.

6. The method of claim 1, wherein the paper strength agent further comprises a polyvinylalcohol.

7. The method of claim 1, wherein the paper strength agent further comprises chitosan.

8. The method of claim 1, wherein the slurry of pulp comprises old corrugated container pulp.

9. The method of claim 8, further comprising blending the old corrugated container pulp with wood kraft pulp.

10. The method of claim 1, wherein from 0.1 to 10% of the paper strength agent by weight of the pulp is added to the slurry.

11. The method of claim 1, wherein from 0.1 to 10% of the paper strength agent by weight of the pulp is added to the slurry.

12. A method for making a pulp product, comprising: adding a paper strength agent to a slurry of pulp, wherein the paper strength agent comprises a polysaccharide and a multifunctional cross linker.

13. The method of claim 12, wherein the polysaccharide comprises esterified starch, ferment-modified starch, hydrolyzed starch, cationic starch, or amphoteric starch.

14. The method of claim 12, wherein the polysaccharide comprises cornstarch, sweet potato starch, potato starch, tapioca starch, or wheat starch.

15. The method of claim 12, wherein the polysaccharide comprises a cellulosic nanocrystal.

16. The method of claim 12, wherein the polysaccharide comprises methylcellulose, hydropropylmethylcellulose, hydroxyethylmethylcellulose, hydroxybutylmethylcellulose, hydroxyethylethylcellulose, or mixtures thereof.

17. The method of claim 12, wherein the cross linker is an aminopolycarboxylic acid.

18. The method of claim 17, wherein the aminopolycarboxylic acid is ethylenediaminetetraacetic acid, diethylenetriaminepentaacetic acid, or a salt thereof.

19. The method of claim 17, wherein the paper strength agent further comprises a polyvinylalcohol.

20. The method of claim 12, wherein the paper strength agent further comprises chitosan.

21. The method of claim 12, wherein the slurry of pulp comprises old corrugated container pulp.

22. The method of claim 21, further comprising blending the old corrugated container pulp with wood kraft pulp.

* * * * *